US005241915A

United States Patent [19]

Breen et al.

[11] Patent Number: 5,241,915

[45] Date of Patent: Sep. 7, 1993

[54] APPARATUS AND METHOD TO IMPROVE PULVERIZER AND REDUCE $NO_x$ EMISSIONS IN COAL-FIRED BOILERS

[75] Inventors: Bernard P. Breen, Pittsburgh, Pa.; James E. Gabrielson, Plymouth, Minn.; John Bjerklie, Upper St. Clair, Pa.

[73] Assignee: Consolidated Natural Gas Service Company, Inc., Pittsburgh, Pa.

[21] Appl. No.: 926,418

[22] Filed: Aug. 10, 1992

[51] Int. Cl.[5] ..... F23K 1/00

[52] U.S. Cl. ..... 110/347; 110/232

[58] Field of Search ..... 110/347, 232, 212, 101 R, 110/104 R; 122/1 A

[56] References Cited

U.S. PATENT DOCUMENTS

| | | | |
|---|---|---|---|
| 3,868,211 | 2/1975 | La Haye et al. | 431/10 |
| 4,442,783 | 4/1984 | Williams | 110/346 |
| 4,597,342 | 7/1986 | Green et al. | 110/347 |
| 4,599,954 | 7/1986 | Williams | 110/346 |
| 4,790,743 | 12/1988 | Leikert et al. | 431/8 |

FOREIGN PATENT DOCUMENTS 0280568 8/1988 European Pat. Off. .

*Primary Examiner*—Edward G. Favors

*Attorney, Agent, or Firm*—Buchanan Ingersoll; Lynn J. Alstadt

[57] ABSTRACT

An apparatus and method to improve pulverizer operation and reduce nitrogen oxide emissions from furnaces which burn pulverized coal from at least one pulverizer. A duct type burner burns a fuel in the primary air which heats the primary air supplied to the pulverizers. The combustion increases the primary air temperature and improves the drying of the coal, thus improving the pulverizer throughput and/or the fineness of the pulverized coal. Operation of the duct burner also reduces the oxygen in the primary air. The reduction in oxygen reduces the propensity of the coal to ignite in the pulverizers and cause fires or even explosions. The reduced oxygen in the primary air also reduces $NO_x$ formation.

20 Claims, 1 Drawing Sheet

APPARATUS AND METHOD TO IMPROVE PULVERIZER AND REDUCE $NO_x$ EMISSIONS IN COAL-FIRED BOILERS

BACKGROUND OF THE INVENTION

1. Field of the Invention

The present invention relates to an apparatus and method for improving pulverizer operation and reducing $NO_x$ formation by burning fuel in the primary air supply line.

2. Description of the Prior Art

In the combustion of coal to raise steam and for other purposes, it is common to first pulverize the coal to a very finely divided size and blow the coal into the furnace as a powder suspended in air and then burn the coal in a flame similar to an oil or natural gas flame. The coal is typically pulverized until most of it is less than 40 micrometers in size. The coal comes from the ground with moisture in it. During storage and transportation it may rain on the coal, and as a result additional moisture may be present in the coal. The moisture prevents efficient pulverization of the coal. To dry the coal, hot air is fed into the pulverizers and the hot air flow then sweeps the milled coal from the pulverizers. When the hot air flow is in the pulverizer, it is in intimate contact with the unmilled and partially milled coal. The flow of the hot air across the coal dries the coal. The partially milled coal is easier to dry than the feed coal since it has a higher surface to volume ratio than the feed coal. During the drying process, the hot air is cooled because much of its energy is given up to evaporate the moisture in the coal. Typically, the incoming air is 400° to 600° F. and the pulverized coal and primary air exit the pulverizer at 135° to 165° F. The large amount of power used to drive the pulverizer ultimately shows up as heat in the coal and primary air, but both that and much of the heat in the incoming air goes to dry the coal.

Excessively wet coal is difficult to handle. At times the drying of the coal is not adequate even though the coal may not be excessively wet. The air is usually heated in an air heater which takes heat from gas leaving the economizer. Often the same air heater used to heat the secondary air is used to heat the primary air. The primary air may be 20% of the total air or 2.5 pounds per pound of coal; however, these ratios can be different in different units and with different coals. If more heat is needed to dry the coal it is often not possible to simply increase the temperature of the incoming air with the prior art air heater.

Using a greater amount of air would supply more energy so that coal could be dried. However, the increased volume would change the cut size on the classifier. Such a change will cause smaller coal sizes to be returned to the pulverizer for further milling which may overload the pulverizers. Also, the increased air volume would increase the flow velocity in the primary pipes which increases the erosion of these pipes. The increased velocity could also change the flame shape or even cause the flame to go out.

Increasing the incoming air temperature would assist in drying the coal. However, the increased air temperature will increase the tendency for fires and explosions in the pulverizer because both the inlet and the outlet temperature would be increased. Increasing the volume increases the exit temperature and thus also increases the tendency for fires and explosions. These events cause millions of dollars in loss of equipment and lost production every year. Typically, one U.S. worker is killed by a pulverizer explosion every year. Even with the constraints of today's operation, there are very important losses due to pulverizer fires and explosions.

Another method of increasing the temperature in the pulverizers and thus improving the drying of the coal is to mix hot flue gas with the incoming air and thereby increase the temperature. This has the advantage of replacing some of the oxygen in the incoming air with other gases. It also has several disadvantages. The flue gas will usually contain some sulfur trioxide ($SO_3$) which will form corrosive sulfuric acid by reacting with water at the temperature of the pulverizer and the acid will corrode the pulverizer, the coal pipes and the burner. The flue gas will contain flyash and this will erode the pulverizer and especially the high pressure fan needed to blow the flue gas into the pulverizer or the exhauster which extracts the gas and coal from the pulverizer.

La Haye and Bjerklie in U.S. Pat. No. 3,868,211 disclose an improved combustion device where flue gas or combustion products are recirculated with the secondary air. While they have made an improvement, it is clearly for natural gas or for oil fuel. It is well known that recirculation of combustion products in the secondary air of a coal-fired surface has little effect on the $NO_x$ emissions. Hence, the process as defined in U.S. Pat. No. 3,868,211 would not reduce $NO_x$ from a coal-fired boiler more than a very small amount. Furthermore, if U.S. Pat. No. 3,868,211 were used on a coal-fired boiler it would not improve the pulverizer operation since the secondary air does not go through the pulverizer.

Nitrogen oxide ($NO_x$) emissions from coal-fired power plants cause considerable damage to the environment. Once discharged to the atmosphere they are converted to nitrogen dioxide ($NO_2$) and this gas is toxic. The gas is brown or red and contributes to the discoloration of air over many cities. The $NO_2$ reacts with water to form nitric acid ($HNO_3$) and the $HNO_3$ is a major component of acid rain. In addition, the $NO_x$ is an important contributor to the major urban air containment, ozone. As a result there are many federal, state, and local limits on the emissions of $NO_x$ from coal-fired power plants. Many devices and techniques for $NO_x$ reduction have been invented and put in use. However, more reductions are needed since the existing $NO_x$ reduction devices are expensive and do not always reach the legal limits.

Thus, equipment and processes which will safely improve coal pulverizer operations, and method and apparatus which will reduce $NO_x$ emissions from coal-fired furnaces are needed.

SUMMARY OF THE INVENTION

We provide an improved apparatus and process to improve coal pulverizer performance and to reduce $NO_x$ emissions from combustion devices. Systems are presently known having a coal-burning furnace, at least one pulverizer in which coal is pulverized, a primary air line connected to each pulverizer and a primary coal-air pipe connected between each pulverizer and the furnace through which the pulverized coal is blown into the furnace. The improvement is comprised of a fuel being burned in the primary air stream before it reaches the pulverizer. A duct burner is provided which uses the pressure and velocity of the air stream to supply the turbulence and recirculation necessary for mixing between the fuel and air and for flame stabilization. The combustion will increase the temperature of the incoming mixture and reduce the oxygen it in.

The hotter incoming air-combustion products will dry the coal more thoroughly and more rapidly. The dryer coal will pulverize more rapidly and with less work by the pulverizer. As a result, the pulverizer can pulverize more coal to the original product size or it can pulverize the same amount of coal to a smaller size. The advantage of increased throughput is partially obvious, but it should be noted that many utility boilers which have been operating on bituminous will be switching to low-sulfur subbituminous coals and the subbituminous coals have less energy per pound of coal. More coal must be pulverized or the units will not be able to produce at their former capacity. So pulverization of more coal in a pulverizer is critical when units are switched to subbituminous coals. The advantage of being able to pulverize the same amount of coal to a smaller size is that the improved pulverization improves the combustion. The combustion is more complete, takes place more quickly, and there is less chance for the flame to impinge on a furnace wall and cause damage to the tubes. The combustion is more complete and there is less carbon monoxide emitted, and less carbon carried out with the ash. Finally, the more rapid combustion leaves the operator more opportunity to reduce the excess air or to take other steps to reduce the $NO_x$ emissions.

The reduced oxygen in the air-combustion products mixture will reduce the tendency for the coal to burn or explode in the pulverizer. This safety feature is due to the fact that there will be less oxygen in the mixture of combustion products and air than there is in air. For most common fuels, combustion will not start with room temperature air and combustion products containing less than 12% oxygen. Oxygen levels less than 21% but more than 12% will limit the fuel concentrations that are combustible and make fires and explosions less vigorous. Thus, the reduced oxygen is a great safety feature and it will allow pulverizers to be operated with higher exit temperatures.

The pulverizer temperatures can be increased from the usual range of 145° to 165° F. and may be operated as high as 190° F. This increased temperature, in addition to improving drying and pulverization, will prevent the condensation of the water vapor in the primary air-coal stream. This condensation frequently causes the coal pipes to plug and this problem is prevented by this invention.

The reduced oxygen in the flue gas has an additional advantage. It will reduce the amount of $NO_x$ emitted from the combustion device. In coal-fired boilers, most of the $NO_x$ is formed from fuel-bound nitrogen. As much as half of the fuel-bound nitrogen is in the volatiles, and by some estimates, the volatile fraction accounts for 60 to 80% of the $NO_x$ from fuel bound nitrogen. This is about 50 to 65% of the total $NO_x$. The volatiles are liberated early and much of them are combusted by the primary air before the stream mixes with the secondary air. This is the point where much of the fuel-bound nitrogen is converted to $NO_x$. By replacing some of the air with flue gas, the temperature of this part of the combustion is reduced which will reduce the conversion of atmospheric nitrogen to $NO_x$, and more importantly, the oxygen concentration is reduced which will make a large reduction in the amount of $NO_x$ formed from the fuel-bound nitrogen in the volatile fraction.and will further reduce conversion of atmospheric nitrogen to $NO_x$. Thus, this invention causes a large reduction in $NO_x$ emissions from pulverized coal-fired furnaces and boilers.

DESCRIPTION OF THE PREFERRED EMBODIMENT

Figure 1:
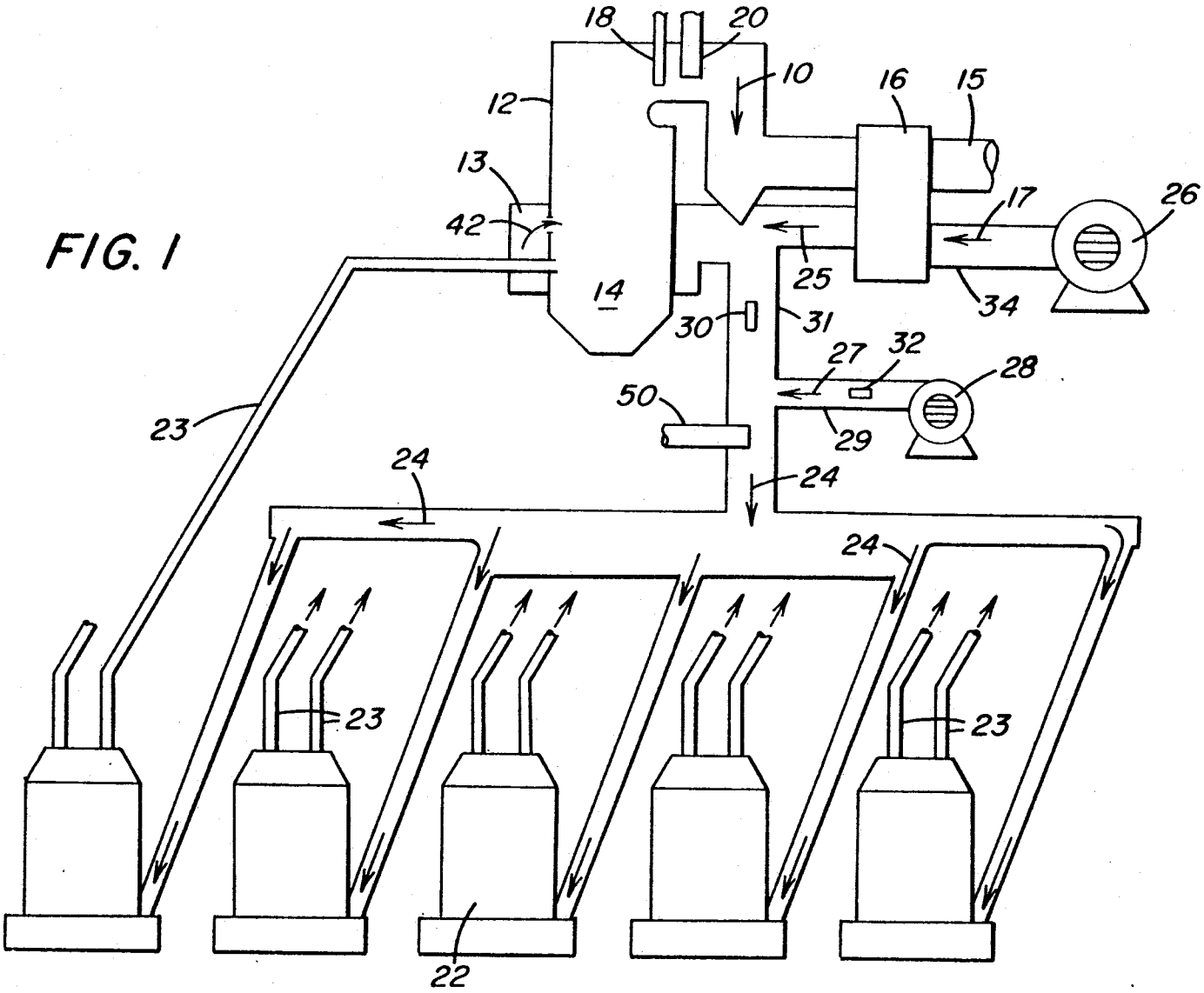
FIG. 1 is a schematic drawing of the preferred embodiment of an apparatus for reducing nitrogen oxide emissions and for improving pulverizer operations in accordance with the principles of the present invention.

As shown in FIG. 1, our apparatus to improve pulverizer operation and to reduce emissions in furnace flue gas 10 can be readily retrofitted to an existing furnace 12. The furnace 12 is designed to consume coal or any other fuel. However, since the improvement is made by altering the coal pulverization step, this invention will be implemented on coal or other pulverizable solid fuel. Various types of coal may be used with the apparatus, such as bituminous, subbituminous, anthracite and lignite.

Coal is pulverized in pulverizers 22 and blown to the furnace in primary air-coal pipes 23 (only one of which is completely shown). In the primary air-coal pipes 23 the coal is dry, the water having evaporated to become water vapor in the air stream. The evaporation has cooled the air stream to about 145° to 175° F. Prior to entering the flue, the flue gas passes through air heater 16 where it gives up much of its remaining heat to the incoming air 17. This heated primary air 24 then exits the air heater 16 and travels to the pulverizers. Hot secondary air 25, which is typically 400° to 600° F., also exits air heater 16 and enters the furnace through intake port 42. A forced draft fan 26 supplies the incoming air 17 through inlet line 34 to the air heater 16. If the primary air 24 leaving the air heater 16 is too hot, tempering air 27 at ambient temperature is supplied through a tempering air line 29 by the tempering air fan 28 and mixed with incoming hot secondary air 25 to make a cooler primary air 24. Although one tempering air line 29 is shown in the figure, any number of tempering air lines 29 having respective tempering air fans 28 may be used.

The coal enters the furnace 12 by way of entries 13 and many others like 13 but not shown. The coal burns in the primary combustion zone 14 which typically has a temperature of about 3000° F. Flue 15 provides an exit for the flue gas which is created in primary combustion zone 14 during the combustion of the fuel. The combustion products give up heat to furnace tubes 18, and convective heat exchangers 20. After giving up heat to the final convective heat exchanger 20, the flue gas will usually have a temperature of 800° to 800° F. and will enter the air heater 16 at these temperatures.

The pulverization of the coal is often delayed due to moisture in the coal. This moisture is evaporated by the heat in the incoming primary air, but the amount of heat may not be sufficient, causing inadequate evaporation which lends to incomplete pulverization or reduced pulverizer capacity. Incomplete pulverization can in turn lead to carbon monoxide emissions, combustibles in the flyash, and even destructive fires in the back end of the furnace. Also during the combustion of the fuel, some of the fixed nitrogen reacts with oxygen to form nitrogen oxide ($NO_x$), and some $NO_x$ is formed from atmospheric nitrogen and oxygen.

We provide duct burner 30 to burn fuel (gaseous or liquid) which is supplied through at least one line 31 (only one of which is shown). The burning of fuel in duct burner 30 consumer part of the oxygen in the incoming air and heats the air. This hotter air improves the pulverizer operation and the diminished oxygen reduces the formation of $NO_x$. Although one duct burner 30 is shown in one line 31, any number of air lines 31 may be used having respective duct burners 30. Alternatively, or in addition to duct burner 30 in line 31, one or more duct burners 32 may be placed in tempering air line 29. The duct burners 30, 32 preferably raise the temperature of the air traveling to the pulverizers by at least 10° F. Additionally, duct burners 30, 32 also preferably raise the temperature of the air/pulverized coal mixture leaving the pulverizers by at least 10°.

The hotter air dries the coal and the dry coal pulverizes more easily and more thoroughly. The result can be that coal can be pulverized at a faster rate. This may allow the furnace to operate at a higher rate. The change will facilitate switching to subbituminous coals which are often low in caloric value so more must be pulverized for a fixed rate of energy release in the combustion zone and the subbituminous coals often have more moisture in them so they need more drying and thus higher incoming air temperature. The enhanced operation will often be used simply to more thoroughly pulverize the coal so it will burn more completely in the primary flame zone 14 and neither solid nor gaseous combustibles will be carried out of the furnace 12. The more finely pulverized coal will allow lower excess operation and other combustion changes which can often be used to cause low $NO_x$ emissions, without flame impingement and without carbon carryover.

The diminished oxygen in the primary air makes a big reduction in the $NO_x$ formation from that part of the fuel bound nitrogen which is in the volatile part of the coal and is liberated early in the combustion process. For example, a furnace can fire with one pulverizer which is capable of pulverizing 100,000 pounds per hour of bituminous coal with a heating value of 12,000 Btu/lb and 6% moisture. This mill is supplied with 180,000 pounds per hour of primary air at 600° F. and the coal and air exit the mill at 165° F. The furnace produced 1,000,000 pounds per hour of superheated steam. The nitrogen oxide emissions are 0.8 pounds of $NO_x$ as $NO_2$ per million Btu input. However, this furnace may be modified according to the present invention such that natural gas is burned in the 600° F. primary air to reduce the oxygen to 12%. One hundred million Btu of energy from natural gas is required for this. The primary air temperature is increased to over 2000° F. A heat exchanger is used to generate additional steam and to cool the primary air back to 600° F. The 100,000 pounds per hour of coal is pulverized while being dried with gas containing only 12% oxygen. The mill is practically immune to fires and explosions. The coal enters the furnace and is burned with the volatiles being consumed in an oxygen deficient environment, the nitrogen oxide emissions are reduced to 0.5 lb of $NO_x$ as $NO_2$ per million Btu. More secondary air may be needed to complete the combustion. The total steam flow in increased by about 8% due to the energy in the natural gas.

As another example, a typical furnace, modified according to the present invention, can be fired with subbituminuos coal containing 20% moisture and having only 10,000 Btu per pound. It is necessary to fire 120,000 pounds per hour of coal to have the same heat input. A total of 24,000 lb per hour of water must be evaporated. In the primary air duct, 20,000 cubic feet per pound of natural gas is burned. The primary air temperature is increased from 600° F. to 1040° F. The hotter gas dries the coal faster and the mill, in spite of the increased water in the coal, is able to pulverize the required 120,000 lb/hr of sub-bituminous coal. The procedure allowed the furnace to operate at full load and the nitrogen oxide emissions were reduced to 0.75 lb of $NO_x$ as $NO_2$/million Btu. This is generally regarded to be a major part of the emission from coal-fired furnaces firing bituminous coal and as even larger fraction of the $NO_x$ emitted from furnace firing subbituminous coal and lignite. The diminished oxygen can cause the early part of the combustion, where the volatiles react with the oxygen in the primary air, to be carried out in an oxygen deficient environment and the result is that the nitrogen which is liberated from the volatile fraction of the fuel almost all ends up as $N_2$ rather than as $NO_x$.

The diminished oxygen reduces the possibility of a fire or explosion in the pulverizer. Even if one should occur, the vigor of the fire or the violence of the explosion will be less. Since the primary air-coal mixture ultimately has too little oxygen to burn all of the fuel, a reduction in the oxygen will decrease the amount of combustion which can be completed before outside air enters the fire. Preferably, the duct burners will consume a sufficient amount of oxygen in the incoming air so that the oxygen content in the lines leading to the pulverizers 22 is less than 12%.

A further improvement is to add a heat exchanger 50 in air line 31 so that part of the heat in the primary air is removed by transfer to water, air, steam, or other materials. By employing this heat exchanger 50, it is possible to operate the duct burners 30 to reduce the oxygen in the incoming primary air 24 and thus the mixture of primary air and pulverized coal that enters the furnace, so the $NO_x$ emissions are reduced and yet control the pulverizer temperature for safety or other operational reasons. Also, more than one heat exchanger 50 may be used so that a plurality of heat exchangers and a plurality of duct burners 30 may be used in combination.

The duct burner 30 in the tempering line 29 can be operated when it is desirable to decrease the concentration of oxygen in the pulverizer while not raising the temperature excessively. When there is an overall requirement for more air than the induced draft fan 26 can supply, the tempering air fan 28 can be used with the duct burner 30 to provide hot combustion products.

One duct burner 30 can be used alone when the highest temperature is needed. However, duct burners 30 and 32 can be used together. The heat exchanger 50 can be used with either burner 30 or 32.

An additional improvement is to use high excess air ceramic or catalytic burners as the duct burners in order to allow optimum flexibility and operating range. The use of a flame holding ceramic or catalytic burner will allow wide range of excess air to be used and the air to be controlled independently of fuel supply so that high excess air can be set for mill flow operation and classifier operation while the temperature can be independently controlled by the amount of fuel added at the ceramic or catalytic burner. Such a burner could provide safety and flame positioning so that the combustion process is completed well before the products enter the pulverizer.

We have presented a method of increasing coal pulverizer performance, enhancing safety, and decreasing $NO_x$ emissions from coal pulverizers.

While we have shown and described a present preferred embodiment of the invention and have illustrated a present preferred method of practicing the same, it is to be distinctly understood that the invention is not limited thereto, but may be otherwise variously embodied and practiced within the scope of the following claims.

We claim:

1. An improved apparatus for enhancing coal pulverizer performance, reducing unwanted fire and explosion hazards, and reducing nitrogen oxide in flue gas, for use with a coal-burning furnace having at least one pulverizer in which coal is pulverized, a primary air line connected to each pulverizer and a primary coal-air pipe connecting each pulverizer to the furnace such that the pulverized coal is blown through the pipe into the furnace, wherein the improvement comprises:

(a) at least one fuel-burning duct burner, each duct burner being situated in a primary air line carrying an air flow to at least one pulverizer, the air flow having a selected concentration of oxygen and a selected temperature wherein each duct burner burns fuel with part of the air in the primary air line and thereby increasing the temperature of the air flow going to the pulverizer, and at the same time reducing the oxygen concentration in the air flow going to the pulverizer.

2. The apparatus of claim 1 wherein the duct burner increases the air flow temperature by at least 10° F.

3. The apparatus of claim 1 wherein the fuel used in the duct burner is a liquid fuel.

4. The apparatus of claim 1 wherein the fuel used in the duct burner is a gaseous fuel.

5. The apparatus of claim 4 wherein the fuel used in the duct burner is natural gas.

6. The apparatus of claim 1 further comprising an air heater connected to the primary air line for heating air traveling to the pulverizers.

7. The apparatus of claim 6 wherein the duct burner is located in a line leading from the air heater.

8. The apparatus of claim 1 further comprising at least one tempering air line for providing ambient air to the air flow.

9. The apparatus of claim 8 wherein at least one duct burner is located in the tempering air line.

10. The apparatus of claim 1 wherein the coal pulverized in the pulverizer is at least one coal selected from the group comprised of bituminous coal, anthracite coal, subbituminous coal and lignite.

11. The apparatus of claim 1 wherein the duct burners are catalytic burners.

12. The apparatus of claim 1 wherein the duct burners are flame holding, ceramic burners.

13. The apparatus of claim 1 also comprising at least one heat exchanger located between the duct burner and the pulverizer to lower the temperature of the gas flowing to the pulverizer.

14. The apparatus of claim 13 wherein a plurality of burners and a plurality of heat exchangers are used in series.

15. A method of improving pulverizer operation, increasing safety, and reducing emissions of nitrogen oxide in a coal-burning furnace system having at least one pulverizer for pulverizing coal and having lines leading air to each pulverizer comprising the step of burning fuel in at least one line leading air to the pulverizers.

16. The method of claim 15 wherein the fuel burned in the air liens causes an increase in the temperature of the air of at least 10° F.

17. The method of claim 15 wherein the fuel burned in the air lines causes an increase in temperature of the pulverized coal and are exiting the pulverizer of at least 10° F.

18. The method of claim 15 wherein the fuel burned by the duct burners is natural gas.

19. A method of claim 15 further comprising the step of lowering the temperature of the resulting gas by transferring some of the heat to at least one of steam and water.

20. The method of claim 19 wherein the gas being led to the pulverizers has an oxygen content below 12%.

* * * * *